United States Patent [19]

Willcocks et al.

[11] Patent Number: 4,985,662

[45] Date of Patent: Jan. 15, 1991

[54] LOW VOLTAGE LAMP SWITCHER CIRCUIT

[75] Inventors: Martin E. G. Willcocks, Los Angeles, Calif.; Rhett McNair, Rte. 13, Box 398, Lake City, Fla. 32055

[73] Assignee: Rhett McNair, Lake City, Fla.

[21] Appl. No.: 370,755

[22] Filed: Jun. 23, 1989

[51] Int. Cl.[5] ..... H05B 41/46

[52] U.S. Cl. ..... 315/90; 315/87; 315/313; 307/38

[58] Field of Search ..... 307/38, 41; 315/87, 315/88, 90, 313, 185 S

[56] References Cited

U.S. PATENT DOCUMENTS

| | | | |
|---|---|---|---|
| 3,636,404 | 1/1972 | Appleton | 315/87 |
| 4,075,501 | 2/1978 | Kondo | 307/41 |
| 4,318,006 | 3/1982 | Himeno | 307/38 |
| 4,326,133 | 4/1982 | Tasma | 307/41 |
| 4,700,110 | 10/1987 | McNair | 315/90 |
| 4,888,494 | 12/1989 | McNair | 315/185 |

*Primary Examiner*—Eugene R. LaRoche
*Assistant Examiner*—Amir Zarabian
*Attorney, Agent, or Firm*—James Creighton Wray

[57] ABSTRACT

An improved lamp switching circuit for switching on a second lamp circuit upon every alternate application of power to a first lamp circuit. A magnetic latching relay alternately connects and disconnects the second lamp circuit in parallel with the first whenever power to the circuit is switched off. The relay is powered by the discharge of one of two capacitors, which respectively operate a set circuit and a reset circuit of the latching relay. Only one of the capacitors is charged at any time. While power is applied to the lamp circuits, one capacitor is charged while the other is kept discharged, in preparation for operation of the latching relay. When power is switched off, a control circuit senses this condition and triggers a thyristor to discharge the capacitor through the corresponding relay coil after a short predetermined time delay. A low voltage regulated power supply is derived from the a.c. power to provide the power needed by the control circuit and to charge the capacitors, making the circuit operation reliable over a wide range of supply voltages and temperatures.

11 Claims, 3 Drawing Sheets

E1
E2
DS1
DS2
L1
L2
P1
P2
P3
S1
K1A
K1B
R10 6.8M
250V
C5 .15
D6 4247
D5 1N
K1
S
R
3.2K
Q3 2N 5064
R9 47
R8 470
C4 .15
R5 6.8M
250V
C7 .01 50V
R6 68K
R4 470
Q2 2N5064
2.2K
R7
C3 .047 400V
D3 IN4005
C2 .01 50V
R2 100 K
Q1 2N 6027
D4 IN 5257B
R3 100K
C1 .022 400V
R1 4.7M
D1 IN 4247
D2 IN4005
R11 10 1/2W
RV1 V ZNR 14K 201U

LOW VOLTAGE LAMP SWITCHER CIRCUIT

BACKGROUND OF THE INVENTION

The present invention is an improved version of the lamp switching device described in U.S. Pat. No. 4,700,110, "Lamp Switching" and a related patent application, entitled "Electromechanical Lamp Switching." (PLEASE INSERT APPLICATION NO.)

The invention is intended for use in an electrical lighting circuit wherein two or more lamps are connected in common to a single wall switch and it is desired to control the level of lighting by selectively switching a subset of total number of lights upon alternate operations of the wall switch. In such a system, the lighting units may typically be fluorescent fixtures with two ballast circuits each supplying one or more lamps. A switching device according to this invention may be installed in some or all of the lighting units, or may control a set of lighting units by means of an ordinary relay.

Initially, each switching device is preset with power applied to switch on the lamps controlled thereby, so that all of the lamps controlled by the wall switch are on. Thereafter, each successive application of power by means of the wall switch causes the controlled lamps to alternate between off and on states, resulting in dim or normal lighting.

Such switching devices, as described in this application and the patent and pending applications previously referred to, ensure a strict alternation between on and off states for each switching unit, ensuring that multiple units will remain in step with each other and that no matter how long the period between new applications of power to the lighting circuit, the memory of the preceding state will be retained. This non-volatile memory of the preceding state may be embodied in a number of physical device types, the preferred embodiments disclosed in the referenced patent and in this application using a magnetic latching relay, which combines the memory and switching functions in one component.

Whereas the previous invention has advantages in requiring very low operating power and therefore being applicable to energy-saving lighting fixtures, the circuits described previously in the referenced patent required high-voltage components as they were designed to work directly from the typical a.c. line voltage of 117V.

The present invention is a further refinement which enables the circuitry to operate at a much lower regulated voltage derived from the a.c. line voltage through power conditioning means, while still consuming very low operating power. This has advantages in reducing the cost of components and improving the reliability, since the high voltages coupled with high operating ambient temperatures can cause gradual degradation of the devices used in the previous invention.

OBJECTS OF THE INVENTION

An object of the invention is to provide for alternate energization of a second circuit whenever a first circuit is energized, said first and second circuits being connected in parallel to a power source through a main switch.

A further object of the invention is to provide for said second circuit to be energized or not in strict alternation regardless of the time between successive energizations of the first circuit.

A further object of the invention is to provide the said switching function with a minimum power consumption so as to conserve energy.

A further object of the invention is to improve the reliability of similar circuitry prescribed by a previous invention which fulfils the above objects by making it less susceptible to component failure induced by high voltages in combination with high ambient operating temperatures.

A further object of the invention is to make it adaptable to use with a wider range of a.c. supply voltages than said prior invention could accommodate.

A further object of the invention is to make the switching function more reliable with respect to variations of the a.c. supply voltage.

SUMMARY OF THE INVENTION

This invention is a power switching circuit comprising power switching means for alternately enabling and disabling second lamp means in a group of first and second lamp means as a switch for the group of lamp means is repeatedly cycled, so that upon each alternate switching on of the group of lamp means the second lamp means will remain off.

Terminals are provided for connection through a main switch to a source of a.c. power of suitable voltage.

First lamp means are connected between the terminals for illuminating the first lamp means on every occasion when the main switch provides power to the terminals from the power source.

Switching means are connected to the terminals for changing from a first condition to a second condition and changing from a second condition to a first condition upon each alternate cycling of the main switch to supply power to the terminals from the source.

Second lamp means connected to the switching means are illuminated when the switching means is in a first condition in which power is supplied from the terminals through the switching means to the second lamp means.

Electronic operating means connected to the switching means changes the state of the switching means to a second condition in which the second lamp means are disconnected from the terminals and back to the first condition in which the second lamp means are connected to the terminals.

Preferred electronic operating means comprises a latching relay and means for driving the relay in either a first direction or a second direction.

Preferably, the means for driving the relay comprises means for driving the relay after power has been removed from the terminals.

In a preferred embodiment, the latching relay has separate set and reset coils, and the driving means comprises a first capacitor connected to the set coil and a second capacitor connected to the reset coil and means for discharging one of the first or second capacitors through the corresponding coil and thereby moving the relay armature in one direction or the other and switching the relay contacts which comprise the switching means to either a first (set) condition or a second (reset) condition.

Charging means is connected to the switching means for selectively connecting the charging means to either the first or the second capacitor to selectively charge the first or second capacitor, whenever power is applied to the terminals.

The preferred apparatus further comprises controlled discharging means for controlling the discharge of one of the capacitors connected to the relay through the corresponding relay coil.

The preferred controlled discharge means comprises a thyristor having a power terminal connected to both set and reset coils of the relay, and having a control terminal and a common terminal which is connected to both first and second capacitors. First and second steering diodes are also provided for connection of the first capacitor to the set coil and of the second capacitor to the reset coil to prevent charging of the second capacitor from the first capacitor via the two relay coils when the selective charging means is applied to charge the first capacitor, and vice versa.

The preferred apparatus also comprises a control circuit for applying a control signal to the control terminal of the controlled discharge device shortly after the power has been removed from the terminals by switching off the main switch or otherwise.

The control circuit preferably comprises a control capacitor in parallel with a discharging resistor and a third diode connected in series with this circuit to the charging means, for charging the control capacitor whenever power is applied to the terminals. Said control capacitor is discharged by the parallel resistor when power is removed from the terminals, shortly developing a sufficient voltage difference between the control terminal and the common terminal of the thyristor to cause it to switch on, thereby discharging either the first or the second capacitor through the corresponding relay coil and operating the switching means.

The preferred apparatus further comprises a low voltage regulated power source means which provides a regulated voltage to the selective charging means and also through the diode to the control capacitor means.

Preferably the low voltage power source means comprises a low-voltage bridge rectifier means having two terminals for a.c. input and positive and negative output terminals; a fourth diode whose anode is connected to the negative output terminal thereof; a Zener diode or other shunt regulator means connected between the positive output terminal and the cathode of the fourth diode; and a fourth capacitor of suitable a.c. voltage rating, connected to one of the a.c. input terminals thereof. The other a.c. input terminal is connected directly to one of the two main power terminals; the other terminal of the fourth capacitor is connected through a current-limiting resistor to the other main power terminal.

Preferably the cathode of said third diode is connected to the negative output terminal of the bridge rectifier, the anode is connected to the control capacitor, the other terminal of which is connected to the positive output terminal of the bridge rectifier.

Preferably, the junction of the third diode and the control capacitor is connected to the gate or control terminal of the thyristor through a trigger diode or diac or a unidirectional trigger circuit of similar characteristics.

In a preferred embodiment a unidirectional trigger circuit suitable for connection between the control capacitor and the control terminal of the thyristor comprises a programmable unijunction transistor, a resistor connected between the gate and anode thereof, a small capacitor connected in parallel with said resistor, and a Zener diode connected between the gate and the cathode thereof. A second resistor is connected between the cathode of the unijunction transistor and the gate of the thyristor, and a third resistor between the gate and the cathode of the thryisotr. Preferably, a small capacitor is also connected between the gate and the cathode of the thyristor, to prevent spurious triggering of the thyristor from noise spikes on the a.c. power input.

The purpose of said diac, trigger diode or unidirectional trigger circuit is to positively fire the thyristor when the control capacitor discharges to the point where the voltage between its negative terminal and the common terminal of the thyristor reaches the breakdown voltage of the diac or of the Zener diode. When this happens, the diac or the unijunction transistor switch to a high-conduction state causing a significant voltage to be applied to the gate of the thyristor, through the second resistor, thereby causing the thyristor to switch on. Since the discharge of the control capacitor commences as soon as power is removed from the terminals, and takes a predetermined time to establish the breakdown voltage required for the diac or trigger circuit, the thyristor is switched on at this predetermined time delay after removal of the power from the circuit.

Preferably first and second discharging resistors are connected in parallel with the first and second capacitors respectively, so as to ensure that when said first capacitor is being charged, the leakage current through said second steering diode is shunted to the common terminal and no charging of the second capacitor occurs.

The time constant of said discharging resistors with said first and second capacitors should be significantly longer than the time constant of the control capacitor and its parallel discharging resistor, but short enough that any residual voltage remaining on the first capacitor after its discharge through the thyristor and the relay coil will be fully discharged by the time that the main switch is next switched on and then off again to initiate a new operation of the control circuit.

Preferably the selective charging means comprises a resistor connected between the positive output terminal of the rectifier bridge and the pole of one of the relay contact sets, the normally closed contact when the relay is reset being connected to the first capacitor and the normally open contact being connected to the second capacitor. When the relay is in the first condition (reset), the first capacitor is selectively charged, and subsequent operation of the control circuit will discharge the first capacitor through the set coil of the relay, switching it to the second (set) condition. If power is again applied, the second capacitor will then be selectively charged, and subsequent operation of the control circuit will cause discharging of this capacitor through the reset coil of the relay, switching it to the reset condition. A second contact set on the relay provides the lamp switching means.

Alternatively, the second contact set of the magnetic latching relay may control a power relay for switching a larger number of lamps on the second lamp circuit.

Preferably a switch means is connected in series with one of the terminals and the electronic control circuit for de-energizing the control circuit to change the condition of the switching means, to permit multiple units to be synchronized during installation or subsequently.

These and other objects and features of the invention are apparent in the disclosure which includes the above and ongoing description including the drawings and claims.

DETAILED DESCRIPTION OF THE DRAWINGS

Figure 1:
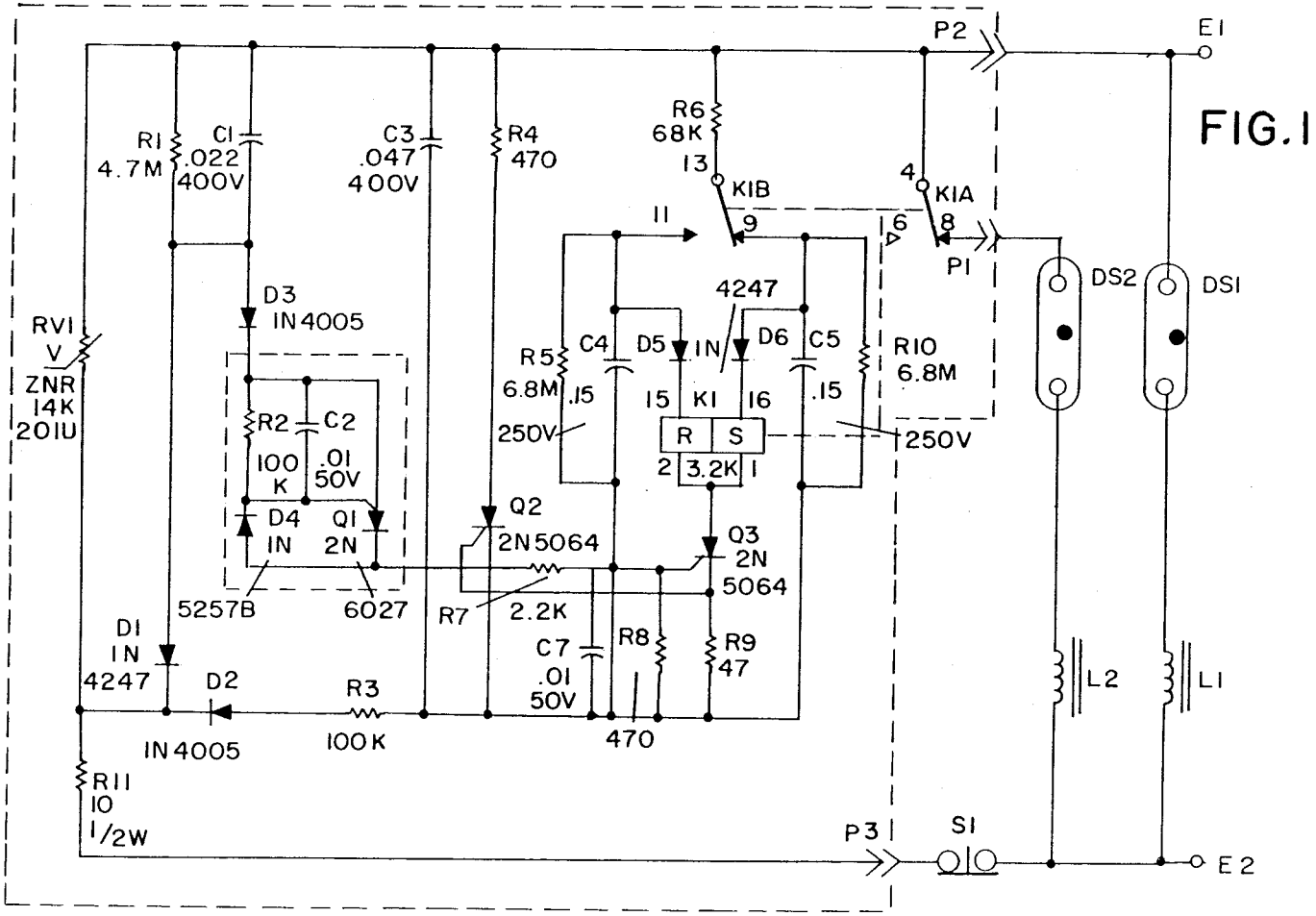
FIG. 1 shows an embodiment of the lamp switching device shown in U.S. Pat. No. 4,700,110.

Referring to FIG. 1, which shows a preferred embodiment of the prior art invention described in U.S. Pat. No. 4,700,110 and is essentially identical to FIG. 3 thereof apart from component numbering. The drawing and description from the patent are included herein as FIG. 1 to aid in understanding of this invention. In this Figure, a first lamp circuit comprising lamp DS1 and ballast choke L1 is connected between power terminals E1 and E2.

A second lamp circuit comprising lamp DS2 and ballast choke L2 is connected through relay contacts K1A to terminals E1 and E2, and is thereby controlled by relay K1.

Relay K1 is a magnetic latching type having two coils labeled S for set and R for reset. In the reset condition as shown, the blackened triangle represents the normally closed contact, and the second lamp circuit is connected to the power terminals.

Connectors P1 and P2 are provided for convenient connection of the external lamp circuits to the printed circuit board containing the components within the dotted outline.

Switch S1 is connected via connector P3 from one power terminal E2 to apply power to the control circuitry on this printed circuit board. It is typically a momentary operation, normally closed, single-pole single-throw push-button switch, and is provided for initially setting the control circuit to the desired state.

Capacitor C5 is connected in parallel with discharging resistor R10 and through steering diode D6 to the set coil of relay K1. Similarly, capacitor C4 is in parallel with discharging resistor R5 and is connected through steering diode D5 to the reset coil of K1. The other terminals of both set and reset coils of relay K1 are connected in common to the anode of thyristor Q3, the cathode of which is connected through a small resistor R9 to the negative terminals of capacitors C4 and C5.

Capacitor C5 is connected via resistor R6 to the supply common terminal E1. The negative terminals of C4 and C5 are connected through resistor R3 and rectifier diode D2 to resistor R11, and thence to the other power terminal E2. When power is applied to the circuit, rectifier D2 half-wave rectifies the a.c. power, storing the peak voltage on reservoir capacitor C3 which is connected between the power terminal E1 and the negative terminals of C4 and C5.

This voltage is applied through resistor R6 and relay contact K1B to capacitor C5, selectively charging it to almost the d.c. voltage developed across C3.

Simultaneously, diode D1 charges capacitor C1 which is connected to the positive rail and E1, so that the voltage at the negative terminal of C1 is more negative than that on the negative terminal of C5. This slight potential difference is provided by the small voltage drop across resistor R3. Resistor R1 provides a discharge path for C1.

The voltage on C1 is applied via diode D3 to a unidirectional trigger circuit which may be replaced by a diac or trigger diode, if preferred. This circuit comprises a programmable unijunction transistor Q1, a resistor R2 connected between its gate and anode, a Zener diode D4 connected between its gate and cathode, and a small capacitor C2 connected in parallel with R2 to prevent spurious operation of Q1 due to noise spikes on the power lines.

The output of this trigger circuit is connected to the gate of thyristor Q3 through resistor R7, which forms a voltage divider with resistor R8 connected from the gate of Q3 to the common terminals of C4 and C5.

A second thyristor Q2 is connected in series with resistor R4 across reservoir capacitor C3, and its gate is connected to the cathode of thyristor Q1. The purpose of this circuit is to discharge capacitor C3 as soon as possible after thyristor Q3 fires.

As diode D5 is reversed biased, capacitor C4 remains discharged with the relay contacts in the condition shown.

When power is removed from the circuit, both C1 and C5 begin to discharge through their parallel resistors. However, the discharge rate of C1 is much greater, and the voltage at its negative terminal rises rapidly with a time constant determined by the values of R1 and C1 until the breakdown voltage of Zener diode D4 is exceeded. This triggers the unijunction transistor Q1, causing the voltage across it to collapse and applying a sharp pulse of about 30 V to the combination of R7 and R8. This voltage is divided by these resistors to provide a pulse of about 8 V to trigger thyristor Q3. Capacitor C7, between the gate and cathode of Q3, has little effect on the size of this pulse, but prevents noise spikes on the a.c. line from being capacitively coupled into the thyristor and causing it to trigger falsely.

When the trigger pulse is applied to the gate of Q3, the thyristor is triggered on, and discharges capacitor C5 through the set coil of relay K1 and steering diode D6, which is forward biased. The current through K1 and the thyristor also develops a voltage across R9 which is sufficient to trigger thyristor Q2. This thyristor then rapidly discharges C3 through resistor R4, which limits the peak discharge current. Most of the charge stored on C5 is discharged through the relay coil, which has a typical resistance of 3.2 kn, but a small portion is discharged through R6 before the relay operates. In addition, when the current through the thyristor falls below about 5 mA, it turns off. This can cause the voltage on the thyristor anode to rise sharply because of the back emf generated by the inductance of K1. However, the voltage spike generated is insufficient to exceed the rating of Q1 with the typical components used.

Varistor RV1 is provided to clamp any voltage spikes across the circuit to about 250 V maximum. The total power consumption of this circuit is only about 10 mW, with the values shown.

Figure 2:
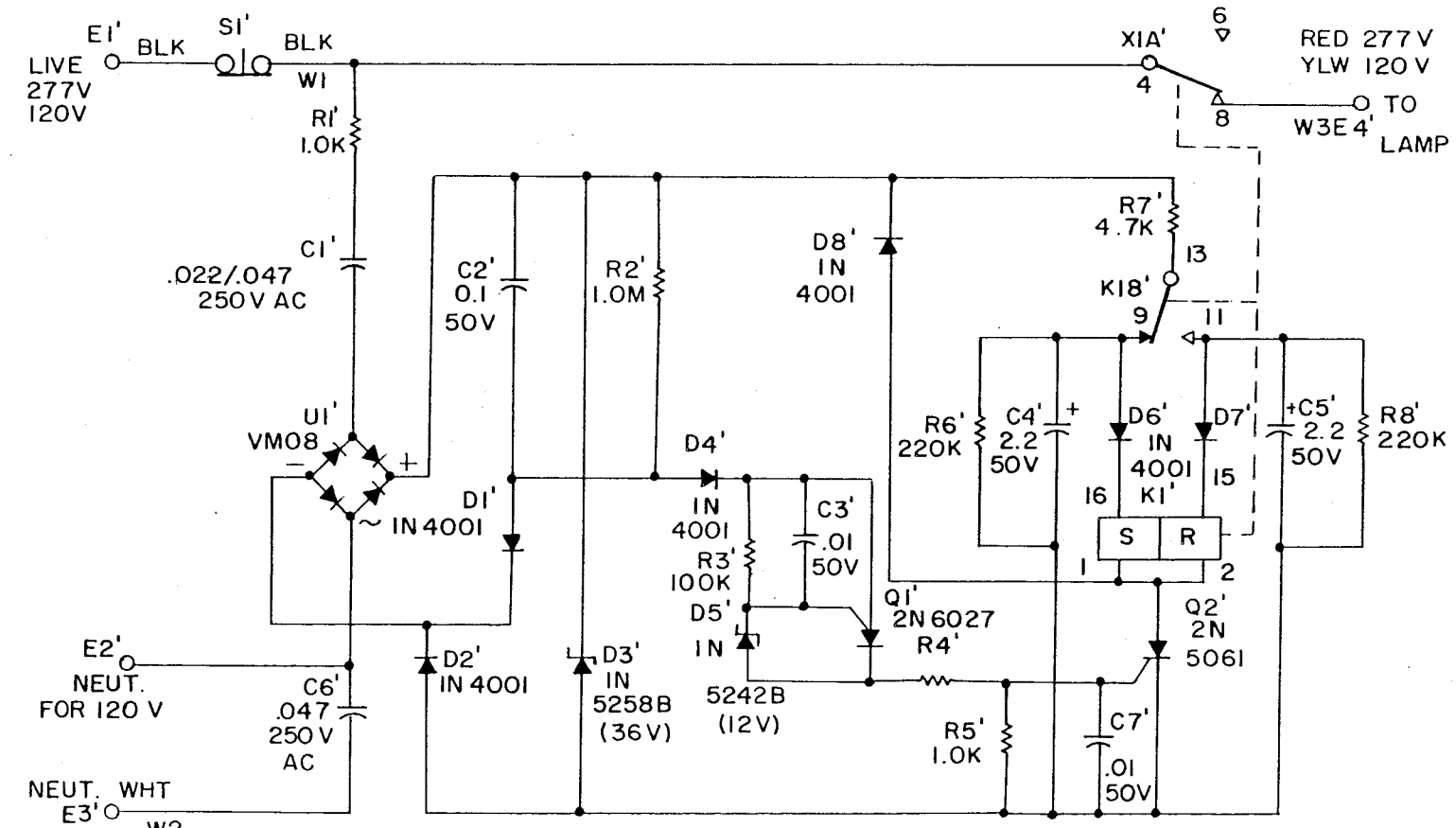
FIG. 2 shows a preferred embodiment of the invention, adapted for use with different a.c. supply voltages.

Referring now to FIG. 2, which shows a dual-voltage version of the improved circuit according to the present invention, the first and second lamp circuits have been omitted for clarity. The first lamp circuit is connected between terminals E1' and one of terminals E2' or E3', depending on the a.c. voltage of the power source, while the second is connected from terminal E4' to the same one of terminals E2' or E3'.

Switch S1' has been moved to an alternate position between terminal E1' and the control circuit, and is also in series with the second lamp circuit. Terminal E1' is normally connected to the live side of the supply, which may be of 120 V a.c. or 277 V a.c. nominal voltage. If the a.c. voltage is 120 V, the neutral side of the supply is connected to terminal E2', or if it is 277 V the neutral is connected to terminal E3'. The principal reason for moving the switch S1' to this new position is to isolate the circuit from the live terminal of the supply upon depressing S1', which must now be adequately rated to control the second lamp circuit load. Since S1' switches the load, and the main switch also switches both lamp circuits, and the relay only operates after power has been removed from the circuit, the relay only requires a rating sufficient to carry the load current, and a static voltage rating adequate for the supply voltage in use. This permits a less expensive relay to be used than if the relay were required to break the circuit while current was flowing.

Once again, the second lamp circuit is energized through the contact set K1A' of relay K1'. In the position shown, the connection is made and the second set of lamps is lit. It does not matter whether the second lamp means is switched on in the set condition of the relay or in the reset condition, as in either case strictly alternating energization of this circuit will result.

The a.c. line voltage is applied through capacitor C1' and limiting resistor R1' to the bridge rectifier U1'. If the 120 V a.c. neutral connection is used, this connects directly to the second a.c. input terminal of U1'. If the 277 V supply voltage is used, the capacitor C6' is also in series with the bridge rectifier. The particular sequence of C1', R1', C6' and the bridge rectifier is unimportant from the point of view of circuit function, and affects only the average potential difference between points in the control circuit and the live or neutral terminals. Placing C1' and R1' on the neutral side of the bridge results in lower voltages between the electronic circuitry and the live terminal, which may have benefits in the printed circuit board layout and some aspects of safety under catastrophic failure conditions.

The bridge rectifier U1' drives directly into Zener diode D3' in series with rectifier D2'. The voltage across the bridge is thus limited to the Zener voltage plus one diode drop. Using a 36 V Zener diode such as industry standard type 1N5258B, limits this voltage to about 36.7 V. The reverse-biased diodes in the bridge therefore only need a rating of 37 V and so a 50 V bridge such as Varo type VM08 can be used. Resistor R1' is provided to limit the surge current to a maximum of twice the peak AC voltage divided by the value of R1'; for the 277 V circuit, this is about 800 mA.

On each half-cycle the voltage applied to the capacitor C1' is reversed; thus the change in voltage on this capacitor is the peak-to-peak supply voltage. For a 120 V supply, this is 339.4 V. The voltage change on C1' is diminished by the voltage across the bridge which includes two more diode drops inside the bridge, so is typically 301.3 V. For a 10% low supply voltage, the capacitor charging voltage is 267.4V. If the capacitor C1' has a value of 0.47 uF and the frequency is 60 Hz, the nominal current through zener diode D3' will be 1.7 mA. Actually, the current demands of the rest of the circuit are subtracted from this value. The use of a capacitor to drop the voltage to the electronic circuit is only possible because the current demand is, like that of the earlier invention, very low. The alternative method would be to use a transformer.

On each half-cycle of the applied a.c. voltage, the waveform across the bridge is heavily clipped, and the Zener diode is conductive through most of the cycle. The voltage across the Zener diode is essentially d.c. with a small dropout at each zero crossing. This voltage is applied through R7' to capacitor C4', charging it to nearly the Zener voltage. Meanwhile, diode D7' is reverse biased, and capacitor C5' is not charged.

The control capacitor C2' is also charged through D1'. The voltage between the negative terminal of C2' and that of C4' is almost zero, since both diodes D2' and D3' have nearly equal forward voltages. This means that no voltage is applied to the gate of thyristor Q2'.

When the supply voltage is present, the current draw is from conduction through R2' and R6', each of which is 220 kn and has about 36V across it, so the total current draw is 0.33 mA. As stated above, about 1.7 mA is available and therefore the Zener current is reduced to about 1.37 mA. The worst case condition would occur for the Zener voltage 5% high, R2' and R6' both 5% low, C1' 20% low and the supply voltage and frequency low; the minimum supply voltage which would sustain operation can then be calculated to be, for a 50 Hz supply frequency, about 48V.

When the supply voltage is removed, the voltage on C2' decreases with a time constant of 22 ms, while that on C4' falls with a much longer time constant of 484 ms. When the voltage on C2' has fallen by about 13V, the 12V Zener diode D5', typically industry standard type 1N5242B, begins to conduct, causing unijunction transistor Q1' to switch on. This device may be an industry standard type 2N6027. When Q1' turns on, it applies a pulse of about 11V to resistor R4', and thence to the gate of thyristor Q2', which is triggered on. This will happen approximately 9 ms after removal of power from the circuit.

When Q1' is switched on, it discharges C4' through the set coil of relay K1' and the diode D6'. The relay is a 24V type and has a coil resistance of typically 3.2 kn, and so the current is initially about 11 mA, falling during the discharge to about 5 mA or less. The value of charging resistor R7' must be large enough, and the value of C1' small enough, that even if the circuit is accidentally triggered while power is applied, it cannot sustain current through the thyristor. This is ensured by the values suggested, and the thyristor drops out of conduction at about 3 to 5 mA.

The back e.m.f. developed when the thyristor drops out of conduction would in this case exceed the voltage rating of the thyristor, so a catch diode D8' is added to prevent the reverse energy from damaging this device, by passing the current into the Zener diode D3' instead.

The pulse of current through the relay lasts sufficiently long to cause it to change state to the set condition. The discharge of C4' continues through the resistor R6'.

The next application of power recharges capacitor C2' and also charges C5' through the resistor R7'. Upon removal of power, the trigger circuit again fires, triggering Q2' on and discharging C5' through the reset coil of the relay. The current pulse causes the relay to change state back to the reset condition. The maximum charging rate of C5' is limited by the smaller available current through C1', and so about 200 ms is required before the circuit is ready to operate again. If the circuit is required to operate sooner, the value of C1' can be increased, but the total power dissipation in the circuit will be increased and the extra power is wasted in the Zener diode.

It has been found that this new circuit can be made to switch reliably over a wider range of supply voltages than the circuit of FIG. 1, for a number of reasons. In the FIG. 1 circuit, the voltage developed across C4 or C5 is about 135V, and is discharged much more rapidly because capacitors C4 and C5 are much smaller than in the present circuit. Therefore, the relay is pulsed ballistically, the electrical current ceasing within the period that the relay takes to change state, and the change of state continuing through the momentum of the armature. Because the voltage is unregulated, the capacitance tolerance, the lowest supply voltage, and the highest amount of charge required to operate the relay must all be taken into account, as well as the temperature coefficients of these components and of the leakage currents of the steering diodes and Q3. These in turn lead to a difficult compromise, with a reduction of switching reliability at high ambient temperatures and when the mains voltage is low.

In addition, the combination of high voltage stress with high temperature can cause gradual degradation of some of the components leading to worsening reliability of operation over a long period of use.

The regulated voltage in the new circuit makes the switching effectively independent of a.c. input voltage. The d.c. voltage is high enough that the worst case relay will still switch within about 3 ms, and the current pulse is sustained for at least twice this time, ensuring that the relay changes state reliably.

Because the capacitors in the original circuit were replaced by much larger values in the circuit of FIG. 2, the capacitor type was changed to an aluminum electrolytic, for lower cost. In environments where high operating temperatures are reached, such as inside the envelope of a lighting fixture, however, the capacitors must be rated to withstand the high temperature for long periods without degradation. Mylar film capacitors with DIN ratings of 100° C. have been used successfully in these cases. Most electrolytic capacitors, including high-temperature types, are not sufficiently reliable for long-term operation at these temperatures.

For operation of the FIG. 2 circuit at 277V the neutral connection is made to terminal E3', which places capacitor C6' in series with C1'. This effectively doubles the voltage rating and halves the capacitance. At nominal voltage, the swing for each half cycle becomes 783.5V less the zener and rectifier drops, or about 745.4V. The d.c. current available is then about 2.1 mA with a second 0.047 uF capacitor for C6'. Alternatively, as in FIG. 3, capacitor C6' and terminal E3' may be eliminated and a different value of capacitor used for C1', for operation at the higher voltage.

The purpose of the limiting resistor R1' is to prevent any surge current at the moment of switch closure from exceeding the ratings of the bridge rectifier. If the capacitor C1' is charged to the peak voltage in one direction, the main switch having just been switched off, and the main switch is switched on at the moment of maximum voltage in the opposite direction, the voltage applied by C1' to the bridge would be as much as 862V. With a resistor of 1000 n, the surge current is limited to 1A, and the surge is dissipated with a time constant of 47 uS, so is effectively completely discharged in 150 uS. The energy dissipated in the resistor is less than 0.1 joules, which the resistor can readily handle.

Figure 3:
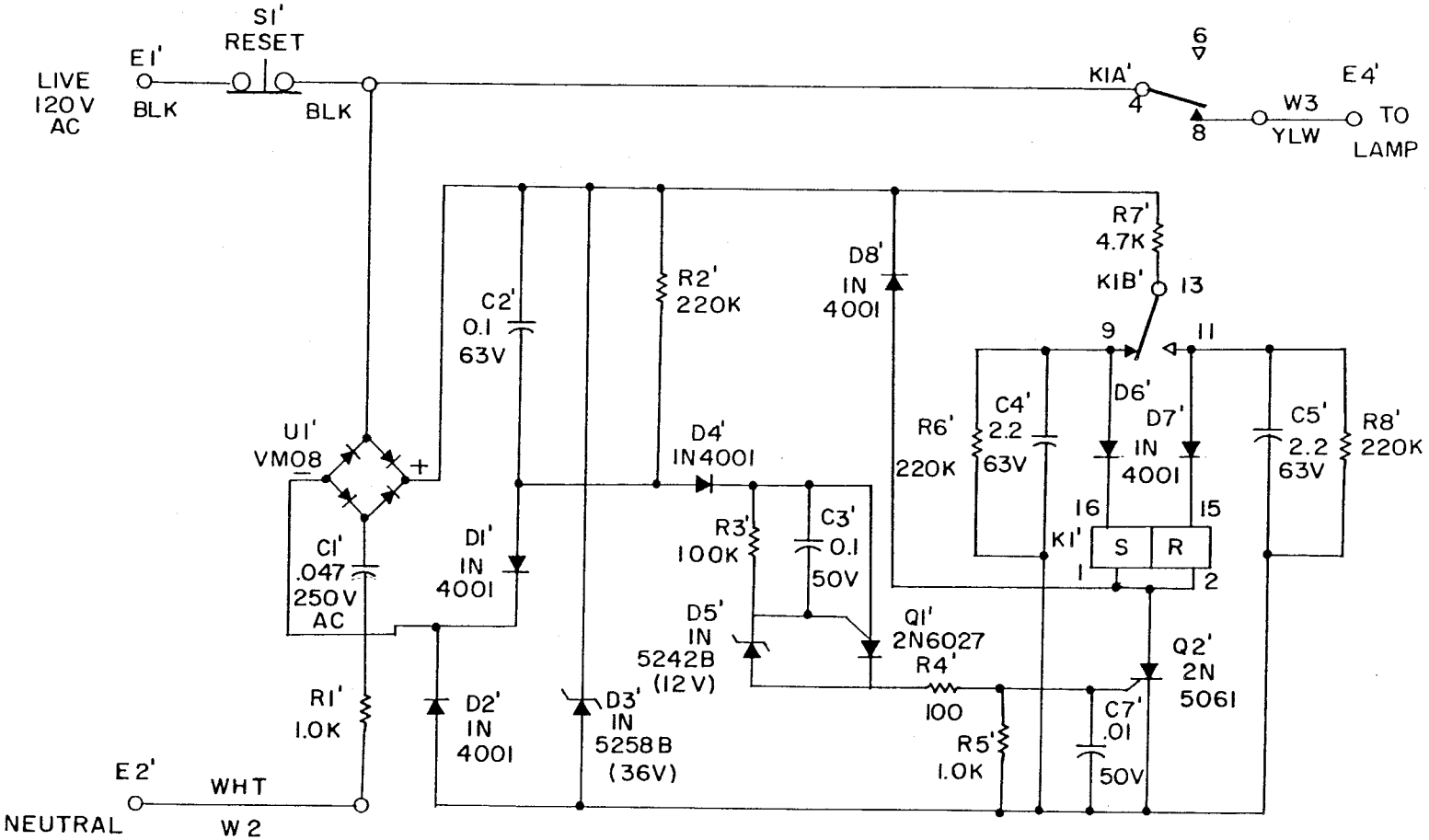
FIG. 3 shows a second preferred embodiment adapted for a single supply voltage, and suitable for use in environments where high ambient temperatures may be encountered.

Referring to FIG. 3, the circuit is the same as that of FIG. 2, except that C1' and R1' are now on the opposite side of the rectifier bridge and C1' may now take a value of 0.022 uF for the case of 277V input, or 0.047 uF for 120V input. The value of 0.022 uF is also suitable for 220V or 240V a.c. at 50 Hz. Thus the same circuit may be configured to accept a range of different a.c. voltages and frequencies with only minor changes to the value of a single component. Although not shown in the schematic, another way to make the same circuit board capable of accommodating both supply voltages is to use one 0.022 uF capacitor for 277V and two in parallel for 120V, providing additional mounting lands for the second capacitor.

While not shown in the drawing, a transformer and a conventional bridge rectifier and regulator circuit could also be used to provide the low-voltage supply to the switching circuit, but would probably cost more than the a.c. rated capacitors shown. The present circuit provides the total power consumption of about 60 mW via the capacitor with a small energy loss, so that the total power consumed is still low enough to permit use of the device inside a typical low-wattage lamp housing where the ambient temperature can exceed 95° C. and the total power loss within the unit is much lower than that of the ballast chokes L1 and L2 shown in FIG. 1 (typically about 4W).

In addition, it has been found that the overall cost of the components in this circuit is slightly less than that of the FIG. 1 circuit, since there are fewer components, and the rectifier leakage currents are much less significant, permitting cheaper types to be used. The extra discharge path for C3, comprising Q2, R4 and R9, is not needed, as C3 is not required in the new circuit. In addition, the expensive varistor RV1 in the circuit of FIG. 1 is not required in the new circuit because the bridge rectifier U1', the capacitor C1' and the zener diode D3' inherently limit the maximum voltage that can appear across the control circuitry. The only components required for circuit protection purposes are the catch diode D8' which prevents excessive voltages across Q2', and the small capacitors C3' and C7' which prevent spurious operation of the circuit from noise spikes on the power lines.

While the present invention has been discussed in reference to the provision of multiple lighting levels by means of controlling a plurality of lighting circuits independently from a single switch, the device may be useful in other control applications such as motor speed or torque control or the switching of dissimilar devices on the same circuit. The devices may be used in multiples for controlling a plurality of lighting fixtures wired to the same circuit, or in tandem to provide more than two levels of lighting, for example. The devices may also be used to control larger loads by the addition of external relays or the use of relays with higher voltage and current ratings as available. Numerous other modifications and variations of the device and many other applications may be apparent to those skilled in the art.

We claim:

1. A power switching circuit means for alternately switching off and on second lamp means in a group of first and second lamp means as the group of lamp means is repeatedly switched on, so that upon each alternate switching on of the group of lamp means the second lamp means remain switched off, comprising:

first and second terminals for connecting to a power source controlled by a main switch, first lamp means connected to the terminals for providing illumination on every occasion when the main switch provides power to the terminals from the power source, third terminal means, switching means connected to said first and third terminals for alternatively connecting and disconnecting said third terminal from said first terminal, second lamp means connected to said third and second terminals for providing illumination on each alternate occasion when the main switch provides power to the terminals from the power source, power conversion means connected to said first and second terminals for converting power from the power source to a regulated direct current output, control circuit means connected to the direct current output of said power conversion means for operating said switching means, comprising means for detection of disconnection of power from said first and second terminals, operating means for switching said switching means for a first condition to a second condition and from the second condition to the first condition and means for determining which of said first and second conditions said switching means is in while power is applied to said first and second terminals, wherein the said power conversion means comprises a bridge rectifier means having two input terminals and a positive and a negative output terminal, a first capacitor connected in series with one of said input terminals and in series with a first resistor to said second terminal, the other of said input terminals being connected to said first terminal, a first diode means whose cathode is connected to said negative output terminal, a Zener diode whose cathode is connected to said positive output terminal and whose anode is connected to the anode of said first diode means, and across which an essentially constant direct voltage is developed for supplying said control circuit means, said first resistor being provided to limit the maximum surge current into said first capacitor to a safe value.

2. The apparatus of claim 1 wherein said switching means comprises a latching relay means having first and second independent contact sets and having a first operating coil for establishing a first set condition and a second operating coil for establishing a second reset condition, said first contact set being connected between said first and third terminals for connecting and disconnecting said second lamp means from the power source.

3. The apparatus of claim 2 wherein said means for detection of disconnection of power in said control circuit means comprises a second diode whose cathode is connected to the negative terminal of said bridge rectifier means, a capacitor in parallel with a resistor connected between the positive terminal of said bridge rectifier means and the anode of said second diode, a third diode whose anode is connected to the junction of said second diode, second resistor and second capacitor, its cathode being connected to triggering means forming part of said operating means of said control circuit.

4. The apparatus of claim 3 wherein said means for determining which of said first and second conditions of said switching means prevails comprises the second contact set of said latching relay means, consisting of a pole contact, a normally closed contact and a normally open contact, said pole contact being connected to said normally closed contact when the relay is in the first reset condition and said pole contact being connected to said normally open contact when the relay is in the second set condition.

5. The apparatus of claim 4 wherein said operating means for switching said switching means in said control circuit means comprises:

a third resistor connected from the positive terminal of said bridge rectifier to the pole contact of said second contact set, a first energy storage capacitor whose positive terminal is connected to the normally closed contact of said second contact set and whose negative terminal is connected to the negative terminal of the power conversion means which is the anode of said zener diode, second energy storage capacitor whose positive terminal is connected to the normally open contact of said second contact set and whose negative terminal is connected to the negative terminal of the power conversion means, first steering diode whose anode is connected to the positive terminal of said first energy storage capacitor and whose cathode is connected to the positive terminal of the set coil of said latching relay, second steering diode whose anode is connected to the positive terminal of said second energy storage capacitor and whose cathode is connected to the positive terminal of the reset coil of said latching relay, first discharging resistor connected in parallel with said frist energy storage capacitor, second discharging resistor connected in parallel with said second energy storage capacitor, electronic switching means connected in common to the negative terminals of both set and reset coils of said latching relay means and to the negative terminal of said power conversion means and having a control terminal means, such that upon application of power from said power conversion means either said first or said second energy storage capacitor is charged through said third resistor and the said second contact set to approximately the regulated voltage of the power conversion means, and upon subsequent application of a control voltage to the control terminal means said electronic switching means completes the circuit comprising the charged energy storage capacitor, the steering diode connected thereto, the set or reset coil of the latching relay, and the electronic switching device, thereby causing the charged energy storage capacitor to be discharged through said steering diode, set or reset coil and electronic switching device, thereby causing the said latching relay to change from the reset to the set condition or from the set condition to the reset condition.

6. The apparatus of claim 5 wherein said electronic switching device is a thyristor whose anode is connected in common to the negative terminals of both set and reset coils of said latching relay, whose cathode is connected to the negative terminal of said power conversion means, and whose gate terminal is the said control terminal.

7. The apparatus of claim 6 wherein said triggering means comprises breakdown means connected from the cathode of said third diode to fourth and fifth resistors connected in series to the negative terminal of the power conversion means, the junction of said fourth and fifth resistors being connected to the gate of the thyristor.

8. The apparatus of claim 7 wherein said breakdown means comprises a programmable unijunction transistor having an anode connected to the cathode of said third diode, said cathode is connected to the said fourth resistor, a sixth resistor connected between the anode and gate of said transistor, a second zener diode whose cathode is connected to the gate of said transistor and whose anode is connected to the cathode of said transistor and to said fourth resistor, such that whenever the voltage applied between anode and cathode of the transistor exceeds the breakdown voltage of the second zener diode, said zener diode conducts and triggers said transistor to a conductive state, causing the voltage at its cathode to rise sharply to that at its anode, thereby applying a pulse through the voltage divider comprising said fourth and fifth resistors to the gate of said thyristor.

9. The apparatus of claim 8 further comprising a catch diode whose anode is connected to the anode of said thyristor and whose cathode is connected to the positive output terminal of said power conversion means for preventing the voltage at the anode of the thyristor from rising above that of the said power conversion means to protect the thyristor from damage due to the back emf generated by the relay coils when the thyristor switches off.

10. The apparatus of claim 9 further comprising a fifth capacitor connected between the gate and the anode of said breakdown device, and a sixth capacitor connected between the gate and the cathode of said thyristor, for the purpose of preventing spurious triggering of either device due to pulses injected into the apparatus from external sources such as the power source.

11. The apparatus of claim 10 further comprising a fourth terminal and a seventh capacitor connected between said fourth and second terminals, for providing an alternate connection for use instead of said second terminal to operate with a higher voltage alternating current source than is permitted to be applied to said second terminal; said first lamp means in this event being connected between said first and fourth terminals and said second lamp means being connected between said third and fourth terminals.

* * * * *